United States Patent [19]

Wakeman et al.

[11] Patent Number: 4,862,844

[45] Date of Patent: Sep. 5, 1989

[54] VALVE ASSEMBLY FOR INTERNAL COMBUSTION ENGINE

[75] Inventors: Russell J. Wakeman; Stephen F. Shea, both of Newport News, Va.

[73] Assignee: Allied-Signal Inc., Morris Township, N.J.

[21] Appl. No.: 233,082

[22] Filed: Aug. 17, 1988

Related U.S. Application Data

[63] Continuation-in-part of Ser. No. 114,353, Oct. 29, 1987, abandoned.

[51] Int. Cl.[4] ..... F01L 9/02

[52] U.S. Cl. ..... 123/90.12; 123/188 AF; 123/90.16

[58] Field of Search ..... 123/90.12, 90.16, 188 AF

[56] References Cited

U.S. PATENT DOCUMENTS

| | | | |
|---|---|---|---|
| 2,595,775 | 5/1952 | De Winngell | 123/90.12 |
| 2,827,884 | 3/1958 | Stivender | 123/90.12 |
| 3,209,737 | 10/1965 | Omotehara et al. | 123/90.12 |
| 3,306,270 | 2/1967 | McCarl | 123/90.12 |
| 3,650,251 | 3/1972 | Pelizzoni | 123/90.16 |
| 3,683,874 | 8/1972 | Berlyn | 123/90.12 |
| 3,738,337 | 6/1973 | Massie | 123/90.12 |
| 3,865,088 | 2/1975 | Links | 123/90.12 |
| 3,938,483 | 2/1976 | Firey | 123/90.12 |
| 4,009,694 | 3/1977 | Firey | 123/90.12 |
| 4,134,371 | 1/1979 | Hausknecht | 123/90.12 |
| 4,167,134 | 9/1979 | Yuda | 92/85.3 |
| 4,269,283 | 5/1981 | Bramberger et al. | 92/85.3 |
| 4,292,886 | 10/1981 | Weber | 92/85.3 |
| 4,615,306 | 10/1986 | Wakeman | 123/90.16 |

FOREIGN PATENT DOCUMENTS

| | | | |
|---|---|---|---|
| 1922850 | 1/1970 | Fed. Rep. of Germany | 123/90.12 |
| 1023116 | 6/1983 | U.S.S.R. | 123/90.12 |

*Primary Examiner*—E. Rollins Cross

*Attorney, Agent, or Firm*—Russel C. Wells

[57] ABSTRACT

An especially adapted engine valve includes structure which damps motion of the valve during its final closure to seat. A spool portion of the valve establishes, with its associated guideway, a damping chamber into which oil under pressure may be admitted via a feed passageway. Oil is discharged through a flow-restricted bleed passageway during closure of the valve so as to create beneficial pressure buildup within the damping chamber and thus reduce the valve's closing velocity. Since the damping functions occur passively (i.e. dependent only upon the relative location of the valve within its guideway), gentle closing of the valve can occur at any point on the cam lobe thereby making it especially well suited for use in "lost motion" valve control systems. The valve is preferably sealed against oil leakage by a pair of axially spaced-apart seal members, and a drain port having an end located between the seal members at all times during the valve's displacements between its opened and seated positions.

18 Claims, 2 Drawing Sheets

VALVE ASSEMBLY FOR INTERNAL COMBUSTION ENGINE

CROSS-REFERENCE TO RELATED APPLICATIONS

This application is a continuation-in-part of copending and commonly owned U.S. patent application Ser. No. 07/114,353 filed on Oct. 29, 1987 now abandoned, in the names of the present applicants, and entitled "Valve Assembly for Internal Combustion Engine".

FIELD OF THE INVENTION

This invention is generally related to the field of internal combustion engines which employ intake and/or exhaust valves. More specifically, the invention, in a preferred form, includes an especially adapted engine valve for damping motion during the valve's final closure to seat.

BACKGROUND AND SUMMARY OF THE INVENTION

In an internal combustion engine which employs intake and exhaust valves, the valve closing velocity is one of the most critical valve train performance parameters. Excessive valve closing velocity can cause such durability problems as high valve seat recession, valve stem stretching, and valve head wear. High valve closing velocities can also cause performance problems, such as valve "bounce" after closing, and high noise levels.

These problems have traditionally been treated in the art by grinding cam shaft lobes such that the valve decelerates as it approaches its seat, and then closes with relatively low velocity. This prior technique has proven quite satisfactory for conventional engines with fixed valve train geometry. Recently, however, hydraulic valve lifters have been employed with greater frequency in internal combustion engines so as to vary valve timing and duration of valve opening to thereby provide more optimum engine performance at various operating conditions (i.e. so-called "lost motion" systems). One such system employing hydraulic valve lifters is disclosed in U.S. Pat. No. 4,615,306 entitled "Engine Valve Timing Control System" of Russell J. Wakeman, issued Oct. 7, 1986 (the entire contents of this prior patent being expressly incorporated hereinto by reference, and referred to hereinbelow as "the Wakeman '306 patent").

In the Wakeman '306 patent, valve timing and valve opening duration are controlled via pressure pulses developed within the engine oil supply as a result of lifter operation. A pair of pistons defines therebetween a chamber in communication with a solenoid which controls the establishment of a hydraulic link between the pistons. As the lower piston of the pair is being moved up the cam's profile, oil is pushed out of the chamber into bleed passageways until such time as the lower piston's displacement is to be hydraulically transferred to the upper piston as dictated by an electronic control unit (ECU). At that time, the solenoid is energized thereby forming a solid hydraulic link coupling the motion of the lower piston to the upper piston which, in turn, actuates valve opening.

As one in this art will appreciate, such a "lost motion" system effectively eliminates the gentle closing ramp associated with the cam. Thus, high valve closing velocities and associated noise and valve durability problems (i.e. excessive valve wear), as has briefly been mentioned above, may result.

While in practice the low velocity opening ramp typically associated with a cam is relatively dispensable since the hydraulics of a "lost motion" system usually has adequate compliance, closing of the valve directly from the high-velocity closing ramp of the cam causes all of the predictable problems mentioned above since the gentle (i.e. low velocity) cam closing ramp effectively disappears when "lost motion" systems are employed. The conventional technique of providing a closing ramp having a more gentle slope (and thus lower valve closing velocity) is not an acceptable solution in "lost motion" systems since the gentle slope of the ramp would consume a considerable amount of cam rotation in order to achieve valve closure to the detriment of engine performance. What has been needed therefore is an engine valve whose motion is damped upon closure to its seat and thus is compatible with "lost motion" valve lifter systems. Moreover, it would be very beneficial if such an engine valve accomplished its damping functions passively (i.e. without requiring additional moving parts other than the valve per se) while yet providing for lower valve closing velocity.

There have been attempts in the past to hydraulically decelerate engine valves upon closure as evidenced by U.S. Pat. Nos. 3,209,737 entitled "Valve Operating Device for Internal Combustion Engine" of Isao Omotehara et al.; 3,938,483 entitled "Gasoline Engine Torque Regulator" of Joseph Carl Firey; 4,009,694 entitled "Gasoline Engine Torque Regulator With Partial Speed Correction" of Joseph Carl Firey; 2,827,884 entitled "Timed Actuator Mechanism" of Paul M. Stivender; and 3,865,088 entitled "Means for Hydraulically Controlling the Operation of Intake and Exhaust Valves of Internal Combustion Engines" of Heinz Links.

In Omotehara et al '737, a hydraulically actuated engine valve is disclosed as including a protrusion 15 formed on a plunger 12 so as to enter the buffer space 13 to force oil out from space 13 through a vent opening 14. This "venting" of oil continues until a needle rod 16 (coaxially formed with protrusion 15) is fully fitted within vent opening 14. Selective dimensioning of clearances between rod 16/vent opening 14 and protrusion 15/buffer space 13 is said to alleviate any impact occurring upon seating of the valve on its seat. There is no practical manner, however, of selecting that point in the valve's closing cycle when valve deceleration will occur since lengthening or shortening the "rod" 16 will have little, if any, impact upon the point in time when the vent opening is fully closed. Moreover, the coaxial disposition of the rod 16 and protrusion 15 renders it capable of use only with hydraulic actuators—as opposed to the use of more conventional mechanical valve actuators employing a valve spring.

Firey '483 and '694 each show an engine valve having a check valve which freely allows oil to flow therethrough during the opening stroke of the valve, but which prevents oil flow therethrough when the valve begins its closing stroke. Such a "dashpot" structure, however, retards the return of the valve to its seat continuously during the valve's entire downstroke to the possible detriment of engine performance.

The engine valve disclosed in Stivender '884 depends upon a complex rotary valve 118 which, in operation, closes the intake and exhaust portions of its cycle just before the plunger 78 has completed its valve opening and valve closing strokes, respectively. By adjusting valves 60 and 62, the rotary valve 118 (as experimentally accomplished on an external test stand) causes the plunger 78 to be decelerated at each end of its stoke before it strikes either of the dash-potting cushions 79, 79' and 81, 81'. While the rotary valve 118 does determine those points in the engine valve's opening and closing strokes where deceleration occurs, it does so at the expense of complex valving mechanisms clearly not suitable for use in today's sophisticated internal combustion engines.

Finally, the engine valve of Links '088 is capable of being hydraulically braked towards the end of either of its strokes by means of a collar 34 formed on work piston 9 which enters in one of the cavities 35 or 35'. The cavities 35, 35' are of a slightly larger diameter as compared to collar 34 so that oil escapes through the narrow clearance formed therebetween and thus cause a dashpot effect to be achieved.

As those in this art will appreciate, none of the prior proposals mentioned above would be suitable for use with a "lost motion" valve control system since there appears to be no precise manner in which one can predetermine that point in the valve's downstroke where deceleration will occur—without resort being made to complex valving structures employing unwanted additional moving parts and their concomitant reliability problems. Thus a simple passive valve deceleration system has been needed but such a need has not, to the best of the Applicants' knowledge, been satisfied.

In accordance with the present invention, however, an especially designed engine valve is provided having a modified valve stem that serves as a hydraulic valve spool—that is, the valve stem includes a section of larger cross-sectional diameter (as compared to the valve stem) so that a hydraulic damping chamber is formed in the valve guideway. The chamber is closed at one end by the sliding spool and at its other end by the valve guide of the smaller diameter stem. As the valve opens, the damping chamber increases in volume and, conversely, decreases in volume as the valve is closed. An oil feed passage and an oil bleed passage open into the damping chamber but are normally closed by the spool's peripheral surface (i.e. when the engine valve is seated). The feed passage is connected to the pressurized engine oil system and is opened at a predetermined point during the valve's opening cycle thereby allowing the damping chamber (with which the feed passage then communicates) to be filled with oil under pressure. The bleed passage, on the other hand, is arranged so that oil is discharged therethrough from the damping chamber to an area of low pressure (typically, within the valve cover) where the discharged oil is recovered by the normal engine oil recirculation system.

At a predetermined location in the engine valve closing cycle, the valve spool will cover, and thus close, the bleed passage thereby sealing it. As the engine valve closes further under the bias influence of the valve spring, the valve spool continues to displace oil (which early in the closing cycle passed through the bleed passageway but which now must pass through high restriction clearance spaces defined between the valve spool and the valve guideway, for example). Thus, upon closure of the bleed passageway, the velocity of the valve is significantly reduced due to oil "trapped" within the damper chamber—this trapped oil then escaping via the high restriction clearance spaces thereby to maintain this substantially reduced closing velocity of the engine valve during its closure to seat.

The location of that end of the bleed passage in communication with the damper chamber relative to the immovable wall of the damper chamber, moreover, establishes the precise point during the valve's closing cycle when motion-damping functions attributable to the structure of this invention will be initiated. This, in turn, permits the valve to be decelerated at any predetermined point of its downstroke which has the advantage of permitting an engine designer to incorporate the valve structures of this invention in a variety of valve opening systems (including "lost motion" systems) without deleteriously affecting engine performance as a result.

The valve is sealed against oil leakage by means of at least one pair of axially spaced-apart seal members. A drain port is defined in the cylinder head and includes an inlet end which communicates with the valve's guideway between the spaced-apart seal members at all times during the valve's stroke between its opened and seated positions. An outlet end of the drain port, communicates with a region of low pressure within the engine oil circulation system (typically, within the valve cover). In such a manner, any oil which may leak past the uppermost one of the seal members is directed, via the drain port, to a low pressure region of the engine oil circulation system. The lowermost one of the seal members, on the other hand, prevents oil leakage into the combustion chamber where it would deleteriously affect engine performance.

These as well as other objects and advantages of the present invention will become more clear to those skilled in this art after careful consideration is given to the detailed description thereof which follows.

BRIEF DESCRIPTION OF THE DRAWINGS

Reference will hereinafter be made to the accompanying drawings depicting a particularly preferred embodiment of this invention, in which like reference numerals throughout the various FIGURES refer to like structural elements. Briefly, the accompanying drawings include.

DETAILED DESCRIPTION OF THE INVENTION

Figure 1:
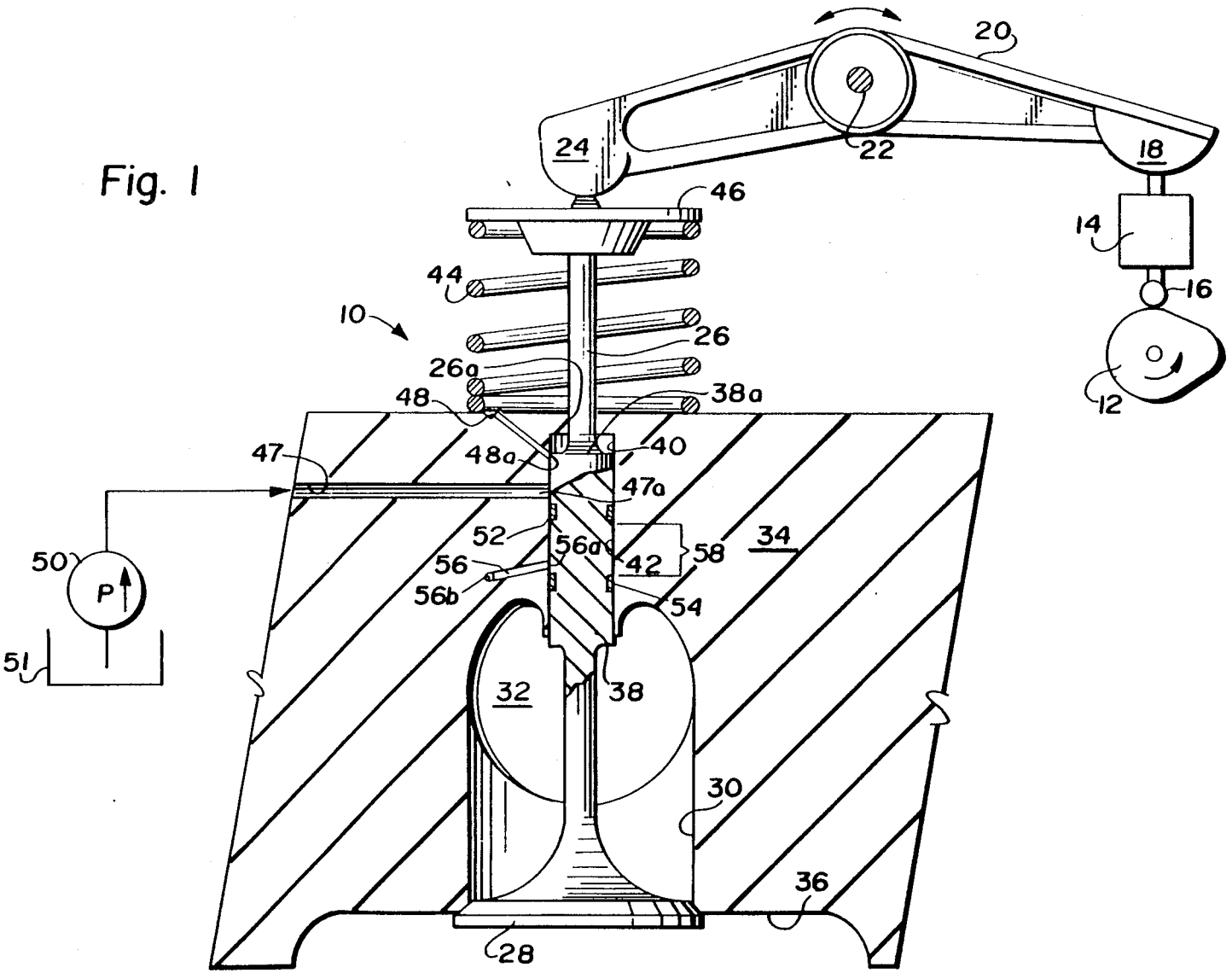
FIG. 1, which is a schematic elevational view, partially in cross-section, of an engine valve control system employing the valve-damping structures of this invention.

FIG. 1 is a schematic elevational view of a valve train employing the valve structures 10 of this invention. As is conventional, the valve train includes a rotatable cam 12 and valve lifter 14 which preferably employs a "lost motion" hydraulic lifter assembly as is disclosed in the Wakeman '306 patent, for example. The lifter 14 includes a cam follower 16 which follows the profile of cam 12, the net effect of which is to displace one end 18 of rocker arm 20. Rocker arm 20, in turn, pivots about its shaft 22 so as to responsively displace its other end 24 acting upon valve stem 26 of valve 28. Although the valve structure 10 of this invention is shown as being utilized in a rocker arm type engine, it may also be suitably employed in engines having other valve lifter motion-transferring structures—for example, engines employing push rods or finger followers, in addition to overhead cam type engines to name a few.

Valve 28 is reciprocally movable relative to opening 30 of port 32 (which may be an intake and/or an exhaust port of a two or four stroke internal combustion engine) defined in cylinder head 34 so as to open and close communication between port 32 and combustion chamber 36.

Structurally, valve 28 includes a spool portion 38 of larger cross-sectional diameter as compared to stem 26 so as to define a damping chamber 40 acting upon spool portion 38 in the valve spool guideway 42. As is seen in FIG. 1, chamber 40 is defined by an upper portion of guideway 42 and is closed at its upper and lower ends via the upper surface 38*a* of spool 38 and the guideway 26*a* of stem 26. It should be understood that stem 26 and guideway 26*a* do not form a "perfect" seal and thus a high restriction clearance space exists therebetween. As is conventional, the valve 28 includes a valve spring 44 maintained under compression between retaining cap 46 (rigidly coupled to valve stem 26) and cylinder head 34 so as to bias valve 28 in a direction toward its seated relationship with respect to opening 30 (i.e. in an upwardly direction as viewed in FIG. 1).

Cylinder head 34 itself defines oil feed and bleed passageways 47, 48, each having an end 47*a*, 48*a*, respectively, laterally opening into spool guideway 42. Feed passageway 47 is in fluid communication with oil pressurized via the engine oil pump 50 so that oil under pressure may be introduced into damping chamber 40 in a manner to be described in greater detail below. The bleed passageway 48, on the other hand, establishes, during strokes of valve spool 38 fluid communication between the damping chamber 40 and a location of low pressure within the engine oil circulation system (typically, within the valve cover which is not shown in FIG. 1) where it is collected and returned to the oil sump 51 in accordance with conventional engine oil recirculation systems which do not need to be discussed in greater detail here.

The valve spool also preferably includes a pair of axially spaced (i.e., relative to the elongated axis of the valve spool) fluid seal members 52 and 54, which serve to prevent oil from leaking between spool 38 and cylinder head 34 into the combustion chamber 36 via opening 30. As one in this art will recognize, oil leaking into combustion chamber 36 would deleteriously affect engine performance. Since pressures within the damping chamber 40 rise dramatically during closure of the valve 28 to seat, some of the oil trapped within the damping chamber 40 will inevitably leak past the uppermost seal member 52 (i.e., since the seal member 52 will not necessarily form a "perfect" seal at the expected pressures occurring within the damping chamber 40).

A drain port 56 is therefore defined in the cylinder block 34 and includes one end 56*a* in communication with the restricted annular clearance 58 established between the spool portion 38 and the spool guideway 42. The axial extent of the restricted annular clearance 58 is thus defined between the axially separated seal members 52 and 54. The drain port 56 also has an opposite end 56*b* which communicates with a low pressure region of the engine oil circulation system and thus serves to remove from the spool guideway 42 any oil which may have leaked past the uppermost seal member 52 into the restricted annular clearance 58. The lowermost seal, on the other hand, serves to prevent such oil leakage from entering the combustion chamber 36 thereby allowing the leaked oil to be removed from the restricted annular clearance 58 via the drain port 56.

The location of the end 56*a* is preselected so that it is in continuous fluid communication within the axial extent of the restricted annular clearance 58 at all times during the reciprocal movements of the valve 28 between its opened and seated positions (i.e., end 56*a* is always located between the axially spaced-apart seal members 52 and 54). In such a manner, any oil which may leak past seal member 52 is transferred to a low pressure region within the engine oil recirculation system rather than being deleteriously introduced into the combustion chamber 36. The relative location of the drain port end 56*a* within the axial extent of the restricted clearance 58 also ensures that the seal members 52 and 54 will not be damaged due to their sliding over end 56*a* during valve movements.

Conventional O-ring type seals are usually insufficient to effectively prevent oil leakage into combustion chamber 36 owing principally to the increased pressures that are encountered within the damping chamber 40 during return of the valve 28 to seat. Thus, according to the present invention, it is preferred that the seal members 52 and/or 54 be embodied in "spring-energized" seals so as to more effectively accomplish the desired sealing function. These seals typically include an outer resilient sealing member and an internal "spring" member which, in use, continuously biases the sealing member into sealing engagement with adjacent structures. One particularly preferred form of such a seal may be commercially obtained from the Advanced Products Company under its registered trademark EnerSeal®.

Although the seal members 52 and 54 are shown in the accompanying FIGURES as being associated physically with the valve spool portion 38 (and thus movable with it during reciprocal movements of the valve 28), it is also possible for one or both of the seal members 52 and 54 to be in a fixed relationship with the guideway 42. In such an equivalent arrangement, therefore, the valve spool portion 38 will slide relative to the fixed-position seal members 52 and 54, but will nonetheless be sealed against oil leakage in a manner similar to that already discussed. Of course, the terminal end 56*a* of drain port 56 will, in this equivalent arrangement, still be located between the axially-spaced, fixed-position seal members 52 and 54 and will be in communication with the restricted annular clearance established between the valve spool portion 38 and the guideway 42.

Figure 4:
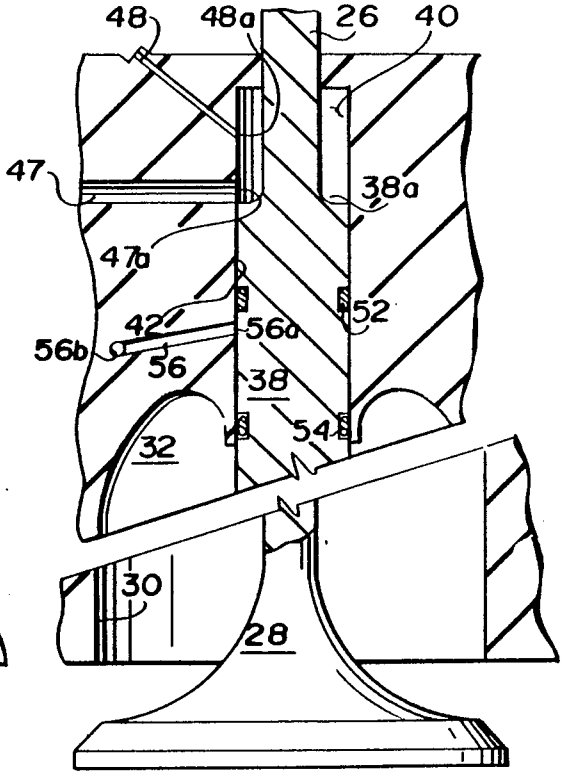
FIG. 4, which is a view of the valve-damping structures of this invention similar to FIGS. 2 and 3, but showing the valve in its opened position.
Figure 3:
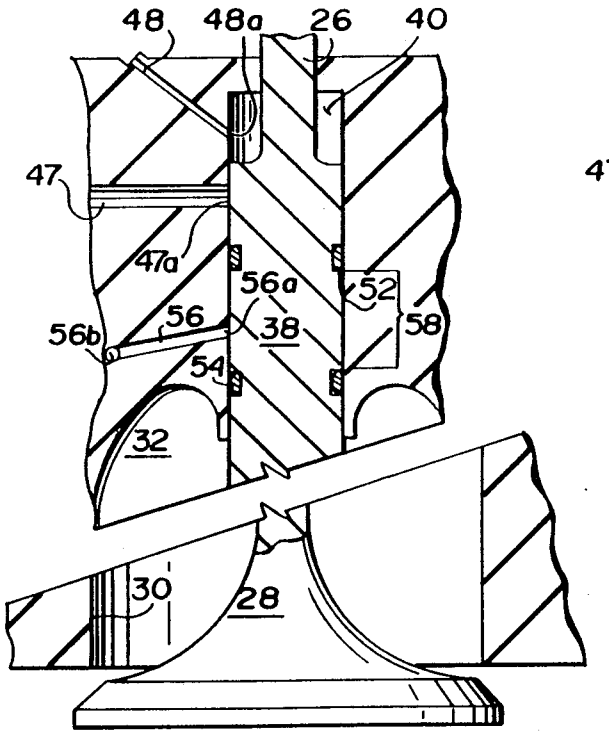
FIG. 3, which is a view of the valve-damping structures of this invention similar to FIG. 2, but showing the valve in a position intermediate its seated and opened positions.
Figure 2:
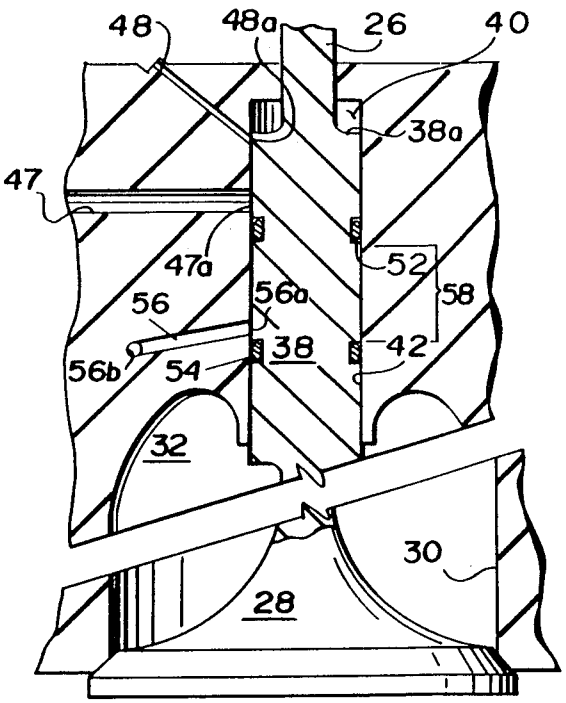
FIG. 2, which is a partial cross-sectional view of the valve-damping structures of this invention wherein the engine valve is shown in a seated position.

In operation, and with particular attention being directed to accompanying FIGS. 2–4, the valve cycle begins with the valve 28 in its "rest" or seated position as is shown in accompanying FIG. 2. In this position, the spool portion 38 of valve 28 closes both the oil feed and bleed passageways 47, 48, respectively. As valve 28 begins to open during its opening cycle, the spool portion 30 will first open communication between bleed passageway 48 and chamber 40, and will thus draw air into the increasing volume of chamber 40. This position of the valve 28 (and more particularly the position of spool portion 38) is shown in FIG. 3. As is seen, the oil feed passageway 47 remains closed by the valve spool portion 38 until such time as the valve 28 is near its fully opened condition as is shown in FIG. 4. At this time, oil under pressure from the engine oil pump P is forced into damping chamber 40 via feed passageway 47 which, in turn, expels air through bleed passageway 48.

It should be noted that, with passageway 47 partially opened by spool portion 38 (that is, at that point when shoulder surface 38*a* just uncovers passageway 47), oil under pressure will be initially admitted into chamber 40. This initial admission of oil will, in turn, act upon the shoulder surface 38*a* of spool portion 38 so as to hydraulically assist rocker arm 20 (or other suitable valve-opening structures) in moving valve 28 to its open position.

When valve 28 is displaced towards its seated position during a closing cycle thereof, oil will be first forced back into feed passageway 47 by the raised pressure in the damping chamber 40, providing little retarding force to the motion of the valve. The oil feed passageway 47 will then be closed thereby stopping the flow of pressurized oil out of chamber 40. At this time, oil within chamber 40 is forced through bleed passageway 48 at a reduced rate owing to the substantially lesser cross-sectional dimension of passageway 48 as compared to the cross-sectional dimension of feed passageway 47. This reduced discharge of oil from chamber 40 via passageway 48 in turn reduces the closing velocity of valve 28. That is, the cross-sectional dimension of passageway 48 causes an advantageous pressure increase within chamber 40 thereby decelerating valve 28 during its closing cycle. Moreover, the reduced rate of oil discharge from chamber 40 via passageway 48 (owing to its reduced cross-sectional dimension) substantially maintains this advantageous pressure buildup relatively constant within chamber 46.

As the valve 28 moves closer to its seat, the bleed passageway 48 will itself be closed so that oil within chamber 40 is effectively "trapped" therewithin. The spring force provided by the valve spring 44 thus continues to urge the valve 28 to its seat and this further increase of pressure within the chamber 40 coupled with the now greatly reduced leakage of oil through restricted clearances (as between the valve stem 26 and its guideway 26*a*) causes the valve 28 to seat the remaining small distance with very slow velocity.

The location of the bleed passageway 48 vis-a-vis the upper surface 38*a* of spool portion 30 determines that point during the closing cycle of valve 28 that damping occurs. Similarly, the rate of damping or deceleration of valve 28 is predetermined by the cross-sectional dimension of the bleed passageway. For example, the cross-sectional diameter of passageway 48 may be 0.050 inch (1.3 mm) with surface 38*a* closing passageway 48 when valve 28 is 0.025 inch (0.63 mm) from its seat.

It will also be observed from FIGS. 2–4 that the location of end 56*a* of drain port 56 relative to the spaced-apart seal members 52 and 54 is such that end 56*a* continuously communicates with the restricted annular clearance 58 at all times during the reciprocal movements of valve 28 between its opened position (i.e., as is shown in FIG. 4) and its seated position (i.e., as is shown in FIG. 2). In such a manner, any oil which may leak past the seal member 52 (as may be occasioned by the previously described advantageous pressure buildup within the damping chamber 40) is removed from the restricted annular clearance 58 so that the seal member 54 may effectively prevent oil from entering the combustion chamber 36.

As can now undoubtedly be appreciated, the system 10 of this invention behaves very similar to conventional systems which employ gentle opening and closing ramps on the cam lobes. However, by utilizing the present invention, gentle closing of the valve can be provided at any point on the cam lobe thereby rendering it suitable for use in a "lost motion" system to reduce the valve motion over its entire range without comprising the cam lobe and without incurring valve crash and its associated durability problems.

Thus, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a valve assembly for an internal combustion engine of the type including a valve having a valve stem, a valve guideway for mounting said valve for reciprocal strokes between opened and seated positions, and spring means for biasing said valve into said seated position, the improvement comprising a valve spool of greater cross-sectional diameter as compared to said valve stem, and a valve spool guideway within which said valve spool is movable during said strokes of said valve, an upper surface of said valve spool and a portion of said spool guideway collectively establishing a damper chamber which varies in volume during said valve strokes, a feed passage for introducing oil into said damper chamber, and a bleed passage for discharging oil from said damper chamber, said feed and bleed passages each laterally opening into said valve spool guideway.

2. In a valve control system of the type comprising a reciprocally movable engine valve, a rotatable cam having a profile, and lifter means for following said cam profile and responsively reciprocally moving said engine valve, said lifter means of the type including a variable hydraulic link so as to control valve opening and duration, wherein the improvement comprises means associated with said valve for decelerating said valve upon closing, said decelerating means including:

a valve spool of greater cross-sectional diameter as compared to said valve stem, and a valve spool guideway within which said valve spool is movable during said strokes of said valve, an upper surface of said valve spool and a portion of said spool guideway collectively establishing a damper chamber which varies in volume during said valve strokes, a feed passage for introducing oil into said damper chamber, and a bleed passage for discharging oil from said damper chamber, said feed and bleed passages each laterally opening into said valve spool guideway.

3. Valve assembly for an internal combustion engine comprising:

a valve having a valve stem;

means for mounting said valve stem to permit reciprocal movements of said valve between opened and seated positions;

said valve stem including a spool portion which defines a damper chamber collectively with said means for mounting;

a feed passage normally closed by means of said spool portion when said valve is in said seated position but which is opened when said valve is moved from said seated to said opened position so as to introduce oil under pressure into said damper chamber; and a restricted flow bleed passage also in communication with said damper chamber for allowing oil to be discharged therethrough when said valve is moved from its said opened position towards its said seated position, said bleed passage being closed by means of said spool portion at a position of said valve just prior to its said seated position, whereby final closure velocity of said valve to said seated position is damped.

4. Apparatus for hydraulically damping velocity of an engine valve only during its closing movement to seat in an opening and closing cycle thereof, comprising:

a damping chamber which is operatively associated with said engine valve;

means for introducing a fluid into said damping chamber;

means for trapping said introduced fluid in said damping chamber at a predetermined location of said valve during its said closing movement so as to decelerate the same from a velocity $V_1$ to a lesser velocity $V_2$; and means for controllably allowing said trapped fluid to escape from said damping chamber so as to substantially maintain said velocity $V_2$ during further movement of said valve from said predetermined location to its said seat.

5. Apparatus as in claim 4, wherein said means for introducing said fluid into said damping chamber includes an entrance port having a cross-sectional area $A_1$, and wherein said means for trapping said fluid includes means for closing fluid communication between said entrance port and said damping chamber at said predetermined location.

6. Apparatus as in claim 5, wherein said means for closing fluid communication includes a region of said valve which closes fluid communication between said entrance port and said damping chamber at said predetermined location.

7. Apparatus as in claim 5, wherein said means for controllably allowing said fluid to escape from said damping chamber includes a bleed port having a cross-sectional area $A_2$ which is less than area $A_1$ of said entrance port and which is sufficient to maintain substantially said velocity $V_2$ of said valve during said closing movement thereof to seat.

8. A hydraulic damping system for an engine valve of an internal combustion engine comprising:

a valve guideway;

a valve having a valve spool mounted within said guideway for reciprocal rectilinear movements between opened and closed positions;

said valve spool having a region of reduced cross-sectional dimension as compared to another region thereof, said reduced cross-sectional region establishing a damping chamber with said guideway;

a feed passageway for introducing oil into said damping chamber;

a bleed passageway for allowing controlled escape of said oil from said damping chamber; wherein said another region of said valve spool constitutes means for closing fluid communication between said feed passageway and said damping chamber at a predetermined position of said valve during movement thereof from said opened position to said closed position so that oil which had been introduced into said damping chamber becomes trapped therein, said trapped oil escaping in a controlled manner from said damping chamber through said bleed passageway so as to reduce the closing velocity of said valve from a velocity $V_1$ just prior to said predetermined position to a lesser velocity $V_2$ just after said predetermined position.

9. An engine valve system as in claim 8, wherein said valve spool further includes seal means for sealing said valve spool and guideway against oil leakage.

10. An engine valve system as in claim 9 wherein said seal means includes an exterior seal member and interior biasing means for biasing said seal member into sealing relationship with said guideway.

11. An engine valve system as in claim 9, wherein said seal means includes a pair of seal members axially spaced from one another, and means defining a drain port having a terminal end located between said pair of seal members at all times during said reciprocal rectilinear movements of said valve spool between said opened and closed positions thereof.

12. A valve assembly for an internal combustion engine comprising:

a valve;

means defining a valve guideway for mounting said valve for reciprocal strokes between opened and seated positions;

seal means for sealing a restricted annular clearance defined between said valve and valve guideway against oil leakage into a combustion chamber with which said valve assembly is associated; and means defining a drain port having a terminal end located in communication with said defined restricted annular clearance at all times during said reciprocal strokes of said valve between said opened and seated positions.

13. A valve assembly as in claim 12, wherein said seal means includes at least one pair of seal members axially spaced from one another so as to establish therebetween an axial extent of said restricted annular clearance, and wherein said terminal end of said drain port is in communication within said axial extent of said restricted annular clearance at all times during said reciprocal strokes of said valve between said opened and seated positions.

14. A valve assembly as in claim 13, wherein at least one of said pair of said seal members includes an exterior seal member and interior biasing means for biasing said seal member into sealing relationship with said guideway.

15. Apparatus for hydraulically damping velocity of an engine valve only during its closing movement to seat in an opening and closing cycle thereof, comprising:

a damping chamber which is operatively associated with said engine valve;

means for introducing a fluid into said damping chamber;

means for trapping said introduced fluid in said damping chamber at a predetermined location of said valve during its said closing movement so as to decelerate the same from a velocity $V_1$ to a lesser velocity $V_2$;

means for controllably allowing said trapped fluid to escape from said damping chamber so as to substantially maintain said velocity $V_2$ during further movement of said valve from said predetermined location to its said seat; and means for sealing said engine valve against oil leakage including (i) a pair of axially spaced seal members in sealing relationship with said valve, and (ii) means defining a drain port having a terminal end located between said axially spaced seal members at all times during said opening and closing cycle of said engine valve.

16. Apparatus as in claim 15, wherein said means for introducing said fluid into said damping chamber includes an entrance port having a cross-sectional area $A_1$, and wherein said means for trapping said fluid includes means for closing fluid communication between said entrance port and said damping chamber at said predetermined location.

17. Apparatus as in claim 16, wherein said means for closing fluid communication includes a region of said valve which closes fluid communication between said entrance port and said damping chamber at said predetermined location.

18. Apparatus as in claim 16, wherein said means for controllably allowing said fluid to escape from said damping chamber includes a bleed port having a cross-sectional area $A_2$ which is less than area $A_1$ of said entrance port and which is sufficient to maintain substantially said velocity $V_2$ of said valve during said closing movement thereof to seat.

* * * * *